US006270079B1

(12) United States Patent
Chamberlain

(10) Patent No.: US 6,270,079 B1
(45) Date of Patent: Aug. 7, 2001

(54) METHOD FOR PLAYING A POKER CARD GAME HAVING A DESIGNATED CARD REQUIRING A PLAYER TO WITHDRAW FROM PLAY

(76) Inventor: Ronald Chamberlain, 9 W. Island Beach, Lebanon, CT (US) 06249

( * ) Notice: Subject to any disclaimer, the term of this patent is extended or adjusted under 35 U.S.C. 154(b) by 0 days.

(21) Appl. No.: 09/275,998

(22) Filed: Mar. 25, 1999

Related U.S. Application Data

(60) Provisional application No. 60/079,473, filed on Mar. 26, 1998.

(51) Int. Cl.[7] ..... A63F 1/00
(52) U.S. Cl. ..... 273/292
(58) Field of Search ..... 273/292, 303–306, 273/308

(56) References Cited

U.S. PATENT DOCUMENTS 4,836,553 * 6/1989 Suttle et al. ..... 273/292
5,423,551 * 6/1995 Stavinsky ..... 273/306

OTHER PUBLICATIONS

"Stud Poker", Scarnes Encyclopedia of Games by John Scarne, Harper & Row publishers, pp. 33–38, Dec. 1973.*

* cited by examiner

*Primary Examiner*—Benjamin H. Layno

(74) *Attorney, Agent, or Firm*—Raymond A. Nuzzo

(57) ABSTRACT

A method of playing a card game. A standard deck of playing cards is used wherein a particular card having a particular value is designated as a dual purpose card that functions as a wild card when face down and a killer card when face up. Each player placing a first predetermined wager and the dealer deals a predetermined number of cards to himself and to each player. At least one of the cards dealt to each player being face down and the card dealt to the dealer being face down. Each player decides whether to stay with the first predetermined wager or place a second predetermined bet that is larger than the first predetermined bet. The dealer deals an additional card to himself and to each player wherein the additional card to each player is face up and the additional cards dealt to the dealer are face down. Next, it is determined if any of the players' face up cards is a killer card. Any player with a killer card must surrender his or her bets and withdraw from play. These steps are repeated. It is then determined if the dealer's hand has a value that is greater than or equal to the value of a predetermined qualifying poker hand. If the dealer does not have a hand that has a value that is greater than or equal to the value of the predetermined qualifying poker hand, then winnings are provided to each player based on each player's first predetermined wager. If the dealer does have a hand that has a value that is greater than or equal to the value of the predetermined qualifying poker hand, and a player has a poker hand that has a value that is greater than or equal to the value of the dealer's hand, then winnings are provided to the player based on the first predetermined wager and the player's second predetermined wager.

15 Claims, No Drawings

METHOD FOR PLAYING A POKER CARD GAME HAVING A DESIGNATED CARD REQUIRING A PLAYER TO WITHDRAW FROM PLAY

This application claims the benefit of commonly owned and copending U.S. Provisional Patent Application Ser. No. 60/079,473 filed Mar. 26, 1998.

BACKGROUND OF THE INVENTION

1. Field of the Invention

The present invention generally relates a method for playing a card game.

2. Problems to be Solved

Poker has become one of the most popular wagering games available at casinos.

Prospective players are always looking for new poker games that are challenging and exciting. On the other hand, casinos and wagering establishments are interested in poker games that will (i) attract more players, (ii) create player loyalty, and (iii) increase revenues to the casinos and wagering establishments. What is needed is a new and improved poker game that meets the needs of the players and casinos or wagering establishments.

Accordingly, it is an object of the present invention to provide a new and improved method for playing a card game that is challenging, exciting and entertaining.

It is another object of the present invention to provide a new and improved method for playing a card game that attracts more players.

It is another object of the present invention to provide a new and improved method for playing a card game that is easy to learn.

It is another object of the present invention to provide a new and improved method for playing a card game that increases revenue to casinos or wagering establishments.

Other objects and advantages of the present invention will be apparent to one of ordinary skill in the art in light of the ensuing description of the present invention.

SUMMARY OF THE INVENTION

The present invention is directed to, in one aspect, a method of playing a card game comprising the steps of (a) providing a standard deck of playing cards comprising a plurality of different card suits, each suit includes a plurality of cards wherein each card has a particular value, all of the suits having in common cards with the same values, (b) designating a card having a particular value as a dual purpose card that functions as a wild card when face down and a killer card when face up, (c) each player placing a first predetermined wager, (d) the dealer dealing a predetermined number of cards to himself and to each player, at least one of the cards dealt to each player being face down and the card dealt to the dealer being face down, (e) providing an opportunity for each player to stay with the first predetermined wager or place a second predetermined bet that is larger than the first predetermined bet, (f) the dealer dealing an additional card to himself and to each player, the additional card to each player being face up and the additional cards dealt to the dealer being face down, (g) determining if any of the player's face up cards is a killer card and requiring any player with a killer card to surrender his or her bets and to withdraw from play, (h) the dealer dealing an additional card to himself and to each remaining player, the additional card to each remaining player being face up and the additional card dealt to the dealer being face down, (i) determining if any of the player's face up cards is a killer card and requiring any player with a killer card to surrender his or her bets and to withdraw from play, (j) revealing all face down cards of the remaining players and the dealer, (k) determining if the dealer's hand has a value that is greater than or equal to the value of a predetermined qualifying poker hand, (l) providing to each player winnings based on each player's first predetermined wager if in step (k), it is determined that the dealer does not have a hand that has a value that is greater than or equal to the value of the predetermined qualifying poker hand; and (m) if the dealer does have a hand that has a value that is greater than or equal to the value of the predetermined qualifying poker hand, then providing to each player winnings based on the first predetermined wager and the player's second predetermined wager if the player has a poker hand that has a value that is greater than or equal to the value of the dealer's hand.

DESCRIPTION OF THE PREFERRED EMBODIMENTS

The card game of the present invention can be played with up to six (6) players plus the dealer. In a preferred embodiment, the card game of the present invention is played by six (6) players plus the dealer. The players are sitting or standing in respective player locations spaced about the periphery of the gambling table. In one embodiment, the table has a generally semi-circular shape and includes a dealer playing station and a plurality of player areas or playing stations surrounding the opposite side of the table that is across from the dealer station. The table has an ante zone for receiving ante wagers. Each player's station has a player card area and betting zones for receiving bets or wagers. The table is also configured to have additional betting zones for receiving jackpot bets.

In a preferred embodiment, the cards are preferably dealt from a single conventional fifty-two card deck which is reshuffled after every hand. In a preferred embodiment, the maximum number of cards a hand may have is five (5). However, in other embodiments of the present invention, the maximum number of cards a hand may have can be fewer or more than five (5) cards.

In accordance with the present invention, a card is designated as a dual purpose card that can function as a "killer" card or as a "wild" card. Under certain conditions, as explained below, the dual purpose card is a "killer" card and forces a player to surrender any and all wagers and to withdraw from the game. Under other conditions, the dual purpose card is a "wild" card and can be used by a player to form a poker hand. In a preferred embodiment, when the dual purpose card is a face up card, it functions as a "killer" card and when the dual purpose card is a face down card, it functions as a "wild" card. In a preferred embodiment, the dual purpose card is the seven (7) card. Thus, any seven (7) card (i.e. 7 Clubs, 7 Hearts, 7 Spades and 7 Diamonds) functions as the "killer" card when it is a face up card and functions as "wild" card when a face down card. As explained above, the seven (7) card, when a "wild" card, can be used to complete a poker hand. In a preferred embodiment, when used to complete a flush, the wild seven (7) can fill up only the highest available opening in the hand. For example, in the case of A-K-7-9-5 suited, the "wild" seven (7) becomes a Queen, making the final hand A-K-Q-9-5. It is to be understood that any other card could be selected as the dual purpose card, e.g. Ace, any card two (2) through ten (10), Jack, Queen, King, Joker, etc. It is to be understood that once a dual purpose card is selected, any card having that same value, regardless of suit, becomes the dual purpose card. Thus, if the King is selected as the dual purpose card, then King of Hearts, King of Diamonds, King of Spades and King of Clubs become the dual purpose card.

The first step of the card game commences with each player placing his or her first or initial predetermined ante bet or wager on the gambling table. The first predetermined or initial ante bet is referred to herein as the "front bet". The required amount of the initial ante bet is determined by the house (i.e. casino). In a preferred embodiment, the gambling table has indicia representing the ante amount shown in ante zone. For example, in one embodiment, the indicia comprises "$2". Thus, each player would have to place a two (2) dollar chip over the indicia in the ante zone.

In the next step, each player has the option to place a bet for the jackpot. If a player desires to place a jackpot bet, the player places the appropriate chip in his or her jackpot betting zone. In one embodiment, the required jackpot bet is one (1) dollar. However, jackpot bets of other amounts can be used as well.

In the next step, the dealer deals three (3) cards to each player in an initial three (3) card deal. In one embodiment, the three cards in the initial three (3) card deal are dealt one at a time. In another embodiment, the dealer deals the three cards all at one time to each player and himself.

In a preferred embodiment, each card is face down. All the dealer's cards are face down. It is to be understood that in other embodiments of the present invention, less than three (3) of the cards are face down. For example, in one embodiment, only one card is face down and the two other cards are face up. In another embodiment, two (2) cards are face down and the remaining card is face up.

The players actually seated at the table are referred to herein as the "present players". The player stations that correspond to empty seats at the table are referred to as "empty seat player stations". If there are "empty seat player stations", then the dealer deals out five (5) cards all at one time to each "empty seat player station". The cards that are placed in each "empty seat player station" are face down.

After the first card of the initial three (3) card deal is dealt to the players, the dealer removes the five (5) cards from the "empty seat player stations" and puts these cards aside but does not place them back in the deck.

After each player receives the three (3) cards of the initial three (3) card deal, each player has the choice of either (i) staying in with the initial ante and jackpot bet, or (ii) placing a second predetermined wager that is larger than the initial ante (i.e. first predetermined wager). This second predetermined wager is referred to as the "back bet". In a preferred embodiment, the second predetermined wager or "back bet" is a multiple of the initial ante. In one embodiment, the second predetermined wager is twice that of the initial ante.

After all the players have acted upon their hands, the dealer deals a fourth card face up to each player and fourth card face down to himself or herself.

Next, all face up cards must be examined to determine if any player received the dual purpose card as the fourth card. In accordance with the method of the present invention, the dual purpose card functions as a "killer" card if it is a face up card. Thus, any player receiving this card as the fourth card is out and loses any bets, i.e. front, back, and jackpot bets.

Next, the dealer deals the remaining players a fifth card face up and himself or herself a fifth card face down. As was done previously, all face up cards are examined to determine if any player received the dual purpose card as the fifth card. In accordance with the method of the present invention, the dual purpose card functions as a "killer" card if it is a face up card. Thus, any player receiving this card as the fifth card is out and loses any bets, i.e. front, back, and jackpot bets.

After the fifth (or last) card is dealt to the players and dealer, the hands of the players are compared to that of the dealer. In order to win a hand, a player must have a poker hand that has a value that is greater than the value of the poker hand of the dealer. However, the dealer's hand must first qualify. In order to determine if the dealer's hand qualifies, the dealer's hand is compared to a predetermined qualifying hand that is set or determined by the house (i.e. casino). The house typically determines the qualifying dealer hand as a result of payout analysis. For example, if the house determines that the qualifying dealer hand is a pair of threes (3, 3), then the dealer must have a poker hand that has a value that is greater than or equal to the value of a pair of threes (3, 3) in order to qualify. In a preferred embodiment, the dealer can qualify if he or she has a pair or better.

The ranking of the poker hands is shown in Table 1.

TABLE I

Ranking of Poker Hands

| Hand | Ranking |
|---|---|
| Royal Flush (Natural or Wild) | 1 |
| Five of A Kind | 2 |
| Straight Flush | 3 |
| Four Of A Kind | 4 |
| Full House | 5 |
| Flush | 6 |
| Straight | 7 |
| Three Of A Kind | 8 |
| Two Pair | 9 |
| One Pair | 10 |

The lowest straight is (Ace-2-3-4-5).

Thus, after the fifth (or last) is dealt to the players and dealer, it must be determined if the dealer's hand qualifies. If the dealer's hand does not qualify, then all front bets are paid and the back bets are not paid and are returned to the players. In a preferred embodiment, if the dealer's hand does not qualify, then all front bets are paid even money and the back bets are returned to the players. Since all the dealer's cards are originally face down, each of the dealer's cards can be wild if it is the dual purpose card.

If the dealer does have a qualifying hand, then a player must beat the dealer's hand in order to win. Thus, if the dealer has a hand of (3,3), a player having a pair of twos (2, 2) would lose. However, a player having a pair of fives (5, 5) would win his or her front and back bets and jackpot bet. In the event that a player has a poker hand that has the same value as the dealer's hand, then it is a "push" with no money changing hands.

If a player has a hand that beats the dealer's qualifying hand, then he or she is paid according to a predetermined payout schedule. As an example, Table II shows one possible payout schedule for front and back bets.

TABLE II

| TYPE OF HAND | PAYOUT |
|---|---|
| Natural Royal Flush | 100 |
| Wild Royal Flush | 10 |
| Straight Flush | 10 |

TABLE II-continued

| TYPE OF HAND | PAYOUT |
|---|---|
| Five Of A Kind | 6 |
| Wild Straight Flush | 5 |
| Four Of A Kind | 4 |
| Full House | 3 |
| Flush | 2 |
| Straight | 2 |
| Three Of A Kind Or Below | 1 |

In a preferred embodiment, the front bet is paid at the same odds as the back bet. For example, if the dealer has a pair of 5s, a player with a full house is paid at 3:1 on his or her front bet, and if he or she has "doubled" up (placed a back bet that is twice the original or initial ante), his or her back bet is paid at 3:1 as well.

As an example, Table III shows one possible payout schedule for jackpot bets.

TABLE III

| TYPE OF HAND | PAYOUT |
|---|---|
| Natural Royal Flush | 20000 |
| Wild Royal Flush | 1000 |
| Five Of A Kind | 500 |
| Straight Flush | 200 |
| Four Of A Kind | 20 |
| Full House | 15 |

TABLE III-continued

| TYPE OF HAND | PAYOUT |
|---|---|
| Flush | 12 |
| Straight | 8 |
| Three Of A Kind | 3 |
| Two Pair | 3 |

EXAMPLE

The following example facilitates understanding of the method of a playing a card game of the present invention. For purposes of this example:

i) the dual purpose card is the seven (7) card (i.e. "wild" and "killer");

ii) six (6) players plus the dealer are playing the game;

iii) the maximum number of cards a player may have is five (5);

iv) the second predetermined wager is double the first or initial predetermined ante or wager;

v) the qualifying hand for the dealer is (3, 3);

vi) front and back bets are paid according to the payout schedule in Table II above; and vii) jackpot bets are paid according to the payout schedule in Table III above.

It is to be understood the example below is for purposes of facilitating understanding a preferred embodiment of the method of the present invention and is not to be construed in a limiting sense.

a) First, each players places his or her initial ante bet or wager and ajackpot bet.

b) Next, the dealer deals three (3) face down cards to each player and himself or herself in an initial three card deal. The cards are dealt one at a time.

c) Table IV below shows the cards that each of the players has after the initial three (3) card deal.

TABLE IV

| PLAYER 1 | PLAYER 2 | PLAYER 3 | PLAYER 4 | PLAYER 5 | PLAYER 6 | DEALER |
|---|---|---|---|---|---|---|
| Face Down | Face Down | Face Down | Face Down | Face Down | Face Down | Face Down |
| Face Down | Face Down | Face Down | Face Down | Face Down | Face Down | Face Down |
| Face Down | Face Down | Face Down | Face Down | Face Down | Face Down | Face Down |

d) Next, the players are given an opportunity to either (i) stay in with the initial ante and jackpot bet, or (ii) place a second predetermined wager that is twice or double the initial ante. In this example, all of the remaining players double the ante.

e) The dealer then deals a fourth card to himself and the players. The fourth card dealt to each player is face up. The fourth card dealt to the dealer is face down. Table V shows the cards that each of the players has after the fourth card is dealt to the players and dealer.

TABLE V

| PLAYER 1 | PLAYER 2 | PLAYER 3 | PLAYER 4 | PLAYER 5 | PLAYER 6 | DEALER |
|---|---|---|---|---|---|---|
| Face Down | Face Down | Face Down | Face Down | Face Down | Face Down | Face Down |
| Face Down | Face Down | Face Down | Face Down | Face Down | Face Down | Face Down |
| Face Down | Face Down | Face Down | Face Down | Face Down | Face Down | Face Down |
| Jack Hearts | 7 Clubs | Queen Clubs | King Hearts | 6 Diamonds | 2 Spades | Face Down |

f) Next, all the players' face up cards are examined to determine if any of the players have a "killer" card. As shown in Table V, Player 2 has a face up card that is a seven (7) of Clubs. Since a seven (7) card is a "killer" card when face up, Player 2 is out and loses his or her bet (ante). Player 2 must withdraw from play.

g) The dealer then deals a fifth card to himself and the players. The fifth card dealt to each player is face up. The fifth card dealt to the dealer is face down. Table VI below shows the cards that each of the players has after the fifth card is dealt to the players and dealer.

TABLE VI

| PLAYER 1 | PLAYER 2 | PLAYER 3 | PLAYER 4 | PLAYER 5 | PLAYER 6 | DEALER |
|---|---|---|---|---|---|---|
| Face Down | Face Down | Face Down | Face Down | Face Down | Face Down | Face Down |
| Face Down | Face Down | Face Down | Face Down | Face Down | Face Down | Face Down |
| Face Down | Face Down | Face Down | Face Down | Face Down | Face Down | Face Down |
| Jack Hearts | 7 Clubs | Queen Clubs | King Hearts | 6 Diamonds | 2 Spades | Face Down |
| 5 Spades | | 2 Hearts | 7 Spades | 4 Hearts | Ace Clubs | Face Down |

h) Next, each fifth card of each of player is examined to determine if any of the players have a "killer" card. As shown in Table VI, Player 4 has a seven (7) of Spades, a "killer" card, and therefore loses all his or her bets and is out. Players 1, 3, 5 and 6 are still in the game.

i) Next, the remaining players and the dealer reveal all the face down cards. Table VII below shows the cards that each of the players and the dealer have after all cards are revealed.

TABLE VII

| PLAYER 1 | PLAYER 2 | PLAYER 3 | PLAYER 4 | PLAYER 5 | PLAYER 6 | DEALER |
|---|---|---|---|---|---|---|
| 7 Hearts | Face Down | Queen Spades | 9 Clubs | 6 Spades | 7 Diamonds | Ace Hearts |
| 8 Hearts | Face Down | 10 Clubs | 3 Spades | 10 Hearts | 4 Diamonds | King Clubs |
| 8 Clubs | Face Down | 3 Clubs | 9 Diamonds | 10 Diamonds | 3 Hearts | Queen Hearts |
| Jack Hearts | 7 Clubs | Queen Clubs | King Hearts | 6 Diamonds | 2 Spades | 4 Spades |
| 5 Spades | | 2 Hearts | 7 Spades | 4 Hearts | Ace Clubs | 4 Clubs |

j) The dealer has qualified because he or she has a pair of fours i.e. (4 Spades, 4 Clubs). Therefore, any player that has a hand that beats the dealer's hand and wins the front, back and jackpot bets. Player 1 has a seven (7) which is "wild". Since the player can equate the "wild" seven to an eight (8) card (or any other card), Player 1 has a three 8s (8, 8, 8) or three of a kind. Since the dealer's hand is only a pair of fours (4, 4), Player 1 is a winner and wins the front and back bets according to the 1:1 payout as shown in Table II above. Player 1 also wins his or her jackpot in accordance with the 3:1 payout as shown in Table III Player 2 is out for the reasons discussed above. Player 3 has a pair of Queens, i.e. (Queen Spades, Queen Clubs). Thus, Player 3's hand beats the dealer's hand and therefore, Player 3 wins his or her front, back and jackpot bets. Player 5 has two pairs, (10 Hearts, 10 Diamonds) and (6 Spades, 6 Diamonds), and therefore wins the front, back and jackpot bets according to the payout schedules in accordance with Tables II and III. Player 6 has a "wild" seven (7) of Diamonds and uses this card as a five card to complete a straight (Ace, 2, 3, 4, 5). A straight beats the dealer's hand. Therefore, Player 6 wins the front, back and jackpot bets in accordance with the payout schedules in Tables II and III.

It is to be understood that the method of playing a card game of the present invention can be played (1) in a casino or other wagering establishment in a manner similar to conventional card games, i.e. "live table version" wherein a group of players and a dealer are positioned at a gaming table, (2) on electronic video gaming machines located in a casino other wagering establishment, or (3) on linked, electronic video gaming machines located in a casino or wagering establishment Furthermore, the present invention can be implemented in a lottery format, e.g. the players' hands and dealer's hand are printed on a "scratch" type ticket that are sold to members of the public.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of playing a card game comprising the steps of:

(a) providing a standard deck of playing cards comprising a plurality of different card suits, each suit includes a plurality of cards wherein each card has a particular value, all of the suits having in common cards with the same values;

(b) designating a card having a particular value as a dual purpose card that functions as a wild card when face down and a killer card when face up;

(c) each player placing a first predetermined wager;

(d) the dealer dealing, in an initial deal, a predetermined number of cards to himself and to each player, at least one of the cards dealt to each player being face down and the cards dealt to the dealer being face down;

(e) providing an opportunity for each player to stay with the first predetermined wager or place a second predetermined bet that is larger than the first predetermined bet;

(f ) the dealer dealing an additional card to himself and to each player, the additional card to each player being face up and the additional card dealt to the dealer being face down;

(g) determining if any of the player's face up cards is a killer card and requiring any player with a killer card to surrender his or her bets to the dealer and to withdraw from play;

(h) the dealer dealing an additional card to himself and to each remaining player, the additional card to each remaining player being face up and the additional card dealt to the dealer being face down;

(i) determining if any of the player's face up cards is a killer card and requiring any player with a killer card to surrender his or her bets to the dealer and to withdraw from play;

(j) revealing all face down cards of the remaining players and the dealer;

(k) determining if the dealer's hand has a value that is greater than or equal to the value of a predetermined qualifying poker hand;

(l) providing to each player winnings based on each player's first predetermined wager if in step (k), it is determined that the dealer does not have a hand that has a value that is greater than or equal to the value of the predetermined qualifying poker hand; and (m) if the dealer does have a hand that has a value that is greater than or equal to the value of the predetermined qualifying poker hand, then providing to each player winnings based on the first predetermined wager and the player's second predetermined wager if the player has a poker hand that has a value that is greater than or equal to the value of the dealer's hand.

2. The method according to claim 1 wherein the dual purpose card is a seven (7).

3. The method according to claim 1 wherein in step (d), the predetermined number of cards is three (3).

4. The method according to claim 3 wherein in step (d), all three (3) cards are face down.

5. The method according to claim 1 wherein in step (d), all the cards are face down.

6. The method according to claim 1 wherein in step (d), the predetermined number of cards is three (3) and one (1) of the cards is face down.

7. The method according to claim 1 wherein in step (d), the predetermined number of cards is three (3) and two (2) of the cards are face down.

8. The method according to claim 1 wherein in step (d), the predetermined number of cards are dealt one at a time and in a consecutive manner to the players.

9. The method according to claim 1 wherein in step (d), the predetermined number of cards are all dealt at one time to each player.

10. The method according to claim 1 wherein step (l) further includes the step of returning the second predetermined wagers to any player who placed a second predetermined wager.

11. The method according to claim 1 wherein in step (e), the second predetermined wager is a multiple of the first predetermined wager.

12. The method according to claim 11 wherein the second predetermined wager is double the first predetermined wager.

13. The method according to claim 1 wherein step (c) further includes the step of providing an opportunity to each player to place a jackpot wager.

14. The method according to claim 13 wherein step (l) further includes the step of returning the jackpot bets to any player who placed a jackpot bets.

15. The method according to claim 13 wherein in step (m), the winnings distributed to each player are based on the first predetermined wager, the player's second predetermined wager, if any, and the player's jackpot wager, if any.

* * * * *